US005657028A

United States Patent [19]

Sanad

[11] Patent Number: 5,657,028

[45] Date of Patent: *Aug. 12, 1997

[54] SMALL DOUBLE C-PATCH ANTENNA CONTAINED IN A STANDARD PC CARD

[75] Inventor: Mohamed Sanad, San Diego, Calif.

[73] Assignee: Nokia Moblie Phones Ltd., Salo, Finland

[ * ] Notice: The term of this patent shall not extend beyond the expiration date of Pat. No. 5,627,550.

[21] Appl. No.: 414,573

[22] Filed: Mar. 31, 1995

[51] Int. Cl.[6] ..... H01Q 1/38

[52] U.S. Cl. ..... 343/700 MS; 343/767; 343/770; 343/702

[58] Field of Search ..... 343/700 MS, 702, 343/846, 767, 770

[56] References Cited

U.S. PATENT DOCUMENTS

| | | | |
|---|---|---|---|
| 4,040,060 | 8/1977 | Kaloi | 343/846 |
| 4,072,951 | 2/1978 | Kaloi | 343/700 MS |
| 4,125,837 | 11/1978 | Kaloi | 343/700 MS |
| 4,138,684 | 2/1979 | Kerr | 343/700 MS |
| 4,291,312 | 9/1981 | Kaloi | 343/700 MS |
| 4,356,492 | 10/1982 | Kaloi | 343/700 MS |
| 4,590,478 | 5/1986 | Powers et al. | 343/700 MS |
| 4,812,855 | 3/1989 | Coe et al. | 343/818 |
| 4,980,694 | 12/1990 | Hines | 343/702 |
| 5,220,335 | 6/1993 | Huang | 343/700 MS |
| 5,373,149 | 12/1994 | Rasmussen | 235/492 |
| 5,420,596 | 5/1995 | Burrell et al. | 343/700 MS |

FOREIGN PATENT DOCUMENTS

| | | |
|---|---|---|
| 0 176 311 A3 | 2/1986 | European Pat. Off. . |
| 0 610 025 A1 | 10/1994 | European Pat. Off. . |
| 0 630 069 A1 | 12/1994 | European Pat. Off. . |
| 0 637 094 A1 | 1/1995 | European Pat. Off. . |
| 58-215807 | 12/1983 | Japan . |
| WO 94/24722 | 10/1994 | WIPO . |
| WO 94/24723 | 10/1994 | WIPO . |

OTHER PUBLICATIONS

Bahl et al. Microstrip Antennas, published by Artech House, Inc., Dedham, MA, 1980, pp. 4–6.

Luk et al., Patch Antennas on a Spherical Body, IEEE Proc. H, vol. 138, No. 1, Feb. 1991, pp. 103–108.

"Study of multilayer microstrip antennas with radiating elements of various geometry", J.P. Damiano, et al., IEE Proceedings, vol. 137, Pt.H. No. 3, Jun. 1990.

"A New Stacked Microstrip Antenna With Large Bandwidth And High Gain", H. Legay and L. Shafai, 1993 International Symposium Digest Antennas and Propagation, vol. 2.

(List continued on next page.)

*Primary Examiner*—Donald T. Hajec
*Assistant Examiner*—Tan Ho
*Attorney, Agent, or Firm*—Perman & Green, LLP

[57] ABSTRACT

A module (1') adapted for insertion into a data processor (2). The module includes an interface (40) for electrically coupling the module to the data processor, a modem (42) that is bidirectionally coupled to the interface, an RF energy transmitter (44) having an input coupled to an output of the modem, an RF energy receiver (46) having an output coupled to an input of the modem, and a partially shorted, dual C-patch antenna (20) that is electrically coupled to an output of the RF energy transmitter and to an input of the RF energy receiver. The partially shorted, dual C-patch antenna is comprised of a truncated ground plane (22), a layer of dielectric material (28) having a first surface overlying the ground plane and an opposing second surface, and an electrically conductive layer (30) overlying the second opposing surface of the dielectric layer. The electrically conductive layer forms a radiating patch and has a rectangularly shaped aperture having a length that extends along a first edge of the electrically conductive layer and a width that extends towards an oppositely disposed second edge. The length has a value that is equal to approximately 20% to approximately 35% of a length of the first edge. The antenna further includes electrically conductive vias or feedthroughs (24) for shorting the electrically conductive layer to the ground plane at a region adjacent to a third edge (20*a*) of the electrically conductive layer.

20 Claims, 3 Drawing Sheets

OTHER PUBLICATIONS

"Improved Bandwidth Of Microstrip Antennas Using Parasitic Elements", C. Wood B.Sc. IEE Proc., vol. 127, Pt. H. No. 4, Aug. 1980.
"Nonradiating Edges and Four Edges Gap–Coupled Multiple Resonator Broad–Band Microstrip Antennas", G. Kumar & K. Gupta, IEEE, vol. AP–33, No. 2, Feb. 1985.
"Compact Broadband Microstrip Antenna", C.K. Aanadan & K.G. Nair, Jul., 1986.
"Handbook of Microstrip Antennas", JR James & PS Hall, vol. 2, 8 pgs, 1989.
"The C–Patch: A Small Microstrip Element" 2 pages.
J.R. James & P.S. Hall, "Handbook of Microstrip Antennas", vol. 2, 1989 Applications in Mobile and Satellite Systems, pp. 1093–1105.
G. Kossiavas et al., "The C–Patch: A Small Microstrip Element", Dec. 15, 1988, 2 pages.
Ninth International Conf. On Antennas & Prop., vol. 1, 4–7 Apr. 1995, Sanad: "A Very Small Double C–patch Antenna Contained in a PCMCIA Standard PC Card", pp. 117–120.
IEEE Antennas & Propagation Society Int. Synposium 1994, vol. 2, 20–24 Jun. 1994, Sanad: "Microstrip Antennas on Very Small Ground Planes for Portable Communication Systems" pp. 810–813.
IEEE Transactions On Antennas & Propagation, vol. 38, No. 5, May 1990, Habashy et al.: "Input Impedance and Radiation Pattern of Cylindrical–Rectangular and Wraparound Microstrip Antennas", pp. 722–731.

SMALL DOUBLE C-PATCH ANTENNA CONTAINED IN A STANDARD PC CARD

FIELD OF THE INVENTION

This invention relates generally to microstrip antenna structures and, in particular, to a C-patch antenna structure.

BACKGROUND OF THE INVENTION

In an article entitled "The C-Patch: A Small Microstrip Element", 15 Dec. 1988, G. Kossiavas, A. Papiernik, J. P. Boisset, and M. Sauvan describe a radiating element that operates in the UHF and L-bands. The dimensions of the C-patch are smaller than those of conventional square or circular elements operating at the same frequency, which are relatively bulky. In general, the dimensions of any radiating element are inversely proportional to the resonant frequency. Referring to FIG. 1, a substantially square electrically conductive radiating element or patch 5 has an aperture that extends part way across the patch. The width (d) of the aperture (12.5 mm) is shown to be 20% of the total width (L=W=62.5 mm) of the patch, while for an example operating at 1.38 GHz (L-band) the width (d) of the aperture (5.5 mm) is approximately 16.7% of the width (L=22 mm, W=33 mm) of the patch. This antenna geometry is shown to exhibit a three- to fourfold gain in area with respect to conventional square or circular antennas, although the bandwidth is somewhat narrower. Good impedance matching with a coaxial feed is shown to be a feature of the C-patch antenna, as is an omnidirectional radiation pattern with linear polarization.

In general, microstrip antennas are known for their advantages in terms of light weight, flat profiles, low manufacturing cost, and compatibility with integrated circuits. The most commonly used microstrip antennas are the conventional half-wavelength and quarter-wavelength rectangular patch antennas. Other microstrip antenna configurations have been studied and reported in the literature, such as circular patches, triangular patches, ring microstrip antennas, and the above-mentioned C-patch antennas.

In the "Handbook of Microstrip Antennas", Volume 2, Ch. 19, Ed. by J. R. James and P. S. Hall, P. Peregrinus Ltd., London, U.K. (1989), pgs. 1092–1104, a discussion is made of the use of microstrip antennas for hand-held portable equipment. A window-reactance-loaded microstrip antenna (WMSA) is described at pages 1099 and is illustrated in FIGS. 19.33–19.36. A narrow reactance window or slit is placed on the patch to reduce the patch length as compared to a quarter-wavelength microstrip antenna (QMSA). The value of the reactance component is varied by varying the width (along the long axis) of the slit. FIG. 19.36*a* shows the use of two collinear narrow slits that form a reactance component in the antenna structure, enabling the length of the radiation patch to be shortened.

The narrow slit does not function as a radiating element, and is thus not equivalent in function to the substantially larger aperture in the above-described C-patch antenna.

So-called PC cards are small form-factor adapters for personal computers, personal communicators, or other electronic devices. As is shown in FIG. 7, a PC card 1 is comparable in size and shape to a conventional credit card, and can be used with a portable computer system 2 that is equipped with an interface 3 that is physically and electrically compatible with a standard promulgated by the Personal Computer Memory Card International Association (PCMCIA). Reference in this regard can be made to Greenup, J. 1992, "PCMCIA 2.0 Contains Support for I/O Cards, Peripheral Expansion", *Computer Technology Review, USA,* 43–48.

PC cards provide the flexibility of adding features after the base computer system has been purchased. It is possible to install and remove PCMCIA PC cards without powering off the system or opening the covers of the personal computer system unit.

The PC card 1 has standard PCMCIA dimensions of 8.56 cm×5.4 cm. The thickness of the PCMCIA card 1 varies as a function of type. A Type II PCMCIA PC card is defined to have a thickness of 0.5 cm. The Type II PCMCIA PC card can be used for memory enhancement and/or I/O features, such as wireless modems, pagers, LANs, and host communications.

Such a PC card can also provide wireless communication capability to laptop, notebook, and palmtop personal computers, and any other computer system having a PCMCIA-compatible interface. The PC card may also work as a standalone wireless communication card when it is not connected to a computer.

For such applications it is required to provide the PC card with a small, built-in antenna having an isotropic radiation pattern. Since the PCMCIA wireless communication card may be hand-held and/or used in an operator's pocket, the antenna should be substantially immune from effects caused by the close proximity of the human body. Furthermore, the portable PCMCIA communication cards are typically randomly orientated during use and, thus, suffer from multipath reflections and rotation of polarization.

Therefore, the antenna should be sensitive to both vertically and horizontally polarized waves. Moreover, the antenna should preferably exhibit the same resonant frequency, input impedance, and radiation patterns when used in free space and when used inside a PCMCIA Type II slot in a conventional portable computer.

It can be appreciated the design of an antenna that meets these various requirements presents a significant challenge.

SUMMARY OF THE INVENTION

The foregoing and other problems are overcome by an antenna structure that is constructed in accordance with this invention. More particularly, this invention provides in a first embodiment a double C-patch antenna, and in a second embodiment a very small size, completely or partially shorted, double C-patch antenna on a very small (truncated) ground plane.

This invention further provides a module adapted for insertion into a data processor. The module includes an interface for electrically coupling the module to the data processor, a modem that is bidirectionally coupled to the interface, an RF energy transmitter having an input coupled to an output of the modem, an RF energy receiver having an output coupled to an input of the modem, and a shorted, dual C-patch antenna that is electrically coupled to an output of the RF energy transmitter and to an input of the RF energy receiver.

The shorted, dual C-patch antenna is comprised of a ground plane, a layer of dielectric material having a first surface overlying the ground plane and an opposing second surface, and an electrically conductive layer overlying the second opposing surface of the dielectric layer. The electrically conductive layer has the shape of a parallelogram and has a rectangularly shaped aperture having a length that extends along a first edge of the electrically conductive layer and a width that extends towards an oppositely disposed second edge. The length has a value that is equal to approximately 20% to approximately 35% of a length of the first edge. In a presently preferred partially shorted embodiment the antenna further includes electrically conductive vias or feedthroughs for shorting the electrically conductive layer to the ground plane at a region adjacent to a third edge of the electrically conductive layer. The antenna also includes a coupler for coupling the electrically conductive layer to the output of the transmitter and to the input of the receiver.

The width of the aperture has a value that is equal to approximately 15% to approximately 40% less than a width of the electrically conductive layer, and is located from the third edge at distance that is approximately equal to the length of the aperture.

The ground plane is truncated, and has dimensions that are approximately equal to the dimensions of the electrically conductive layer.

In a presently preferred embodiment of this invention the module is a wireless communications PC card having dimensions of 8.5 cm×5.4 cm by 0.5 cm, and is thus form and fit compatible with a PCMCIA Type II PC card.

BRIEF DESCRIPTION OF THE DRAWINGS

The above set forth and other features of the invention are made more apparent in the ensuing Detailed Description of the Invention when read in conjunction with the attached Drawings, wherein.

DETAILED DESCRIPTION OF THE INVENTION

Figure 2:
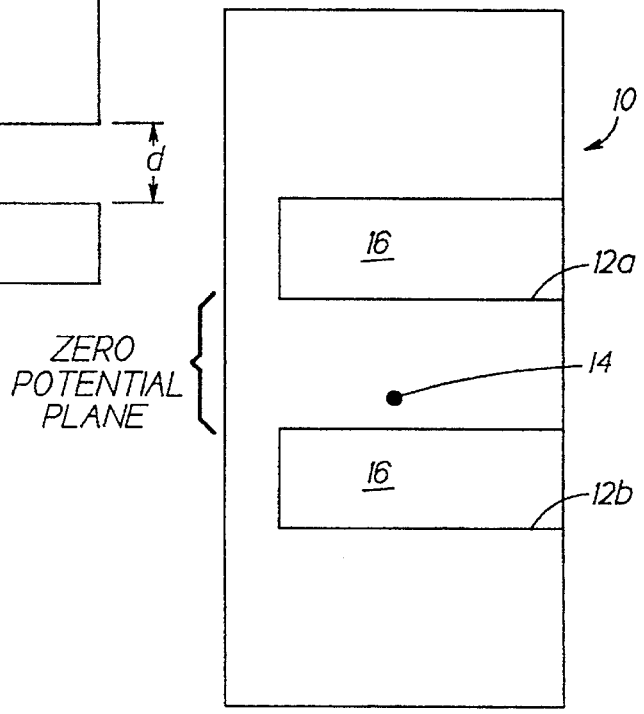
FIG. 2 is a plane view of a double C-patch antenna in accordance with an aspect of this invention.

The geometry of a double C-patch antenna 10, having rectangularly shaped apertures 12*a* and 12*b*, is shown in FIG. 2. This antenna structure differs most significantly from the above-described C-patch antenna described by Kossiavas et al. by having two radiating apertures 12*a* and 12*b*, as opposed to the single aperture described in the article. The antenna 10 is coaxially fed at the point 14 which is asymmetrically located between the two apertures 12*a* and 12*b* (i.e., the point 14 is located nearer to one of the apertures than the other). The region between the two apertures 12*a* and 12*b* is a zero potential plane of the antenna 10. A ground plane (not shown) covers a back surface of the antenna 10, and is spaced apart from the antenna metalization 18 by an intervening dielectric layer 16. The dielectric layer 16 is exposed within the regions that correspond to the apertures 12*a* and 12*b* . The various dimensional relationships between the antenna elements will be made apparent during the discussion of the partially shorted embodiment described next, it being realized that the embodiment of FIG. 2 is essentially a mirror image of the embodiment of FIG. 3.

Figure 1:
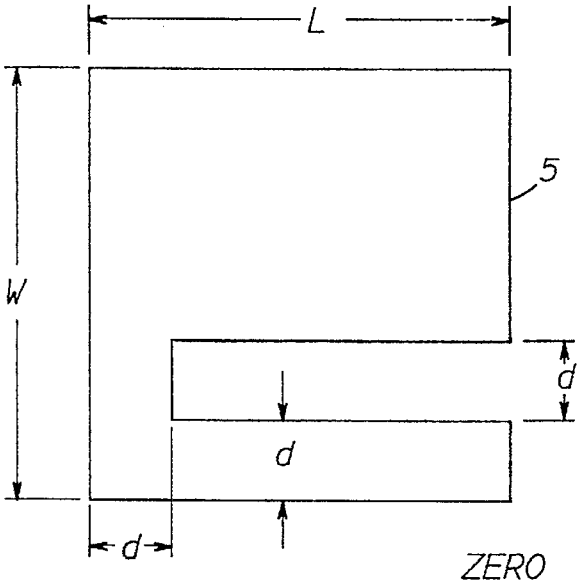
FIG. 1 PRIOR ART
FIG. 1 is a plane view of a prior art C-patch antenna structure.

In general, and for a selected resonant frequency, the antenna 10 of FIG. 2 has a smaller size than a conventional half-wavelength rectangular microstrip antenna. Furthermore, for a selected resonant frequency, the antenna 10 has a smaller size than the conventional C-patch antenna 5 shown in FIG. 1. However, for some applications (such as a PCMCIA application) the overall area of the double C-patch antenna 10 may still be too large.

Figure 3:
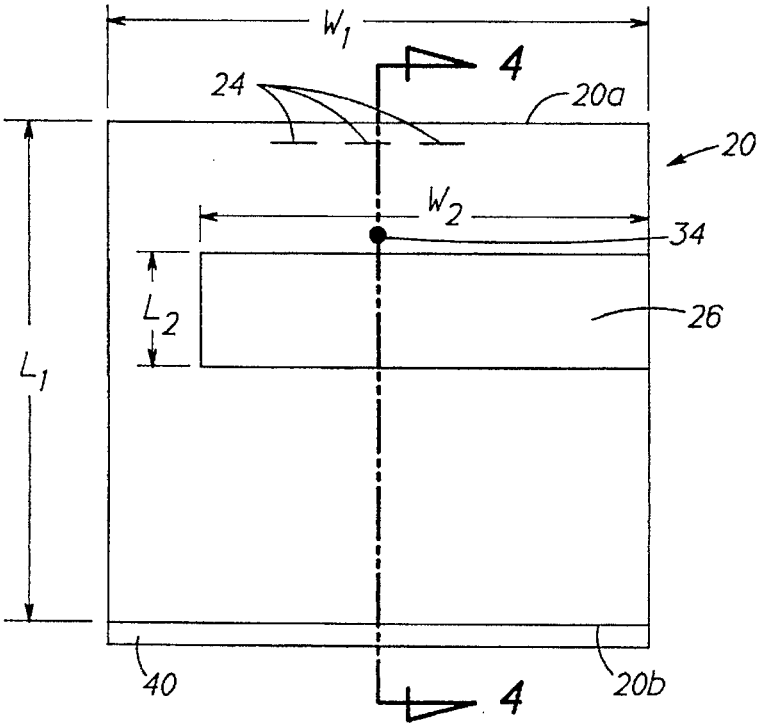
FIG. 3 is an enlarged plane view of a partially shorted, double C-patch antenna in accordance with the teaching of this invention.
Figure 4:
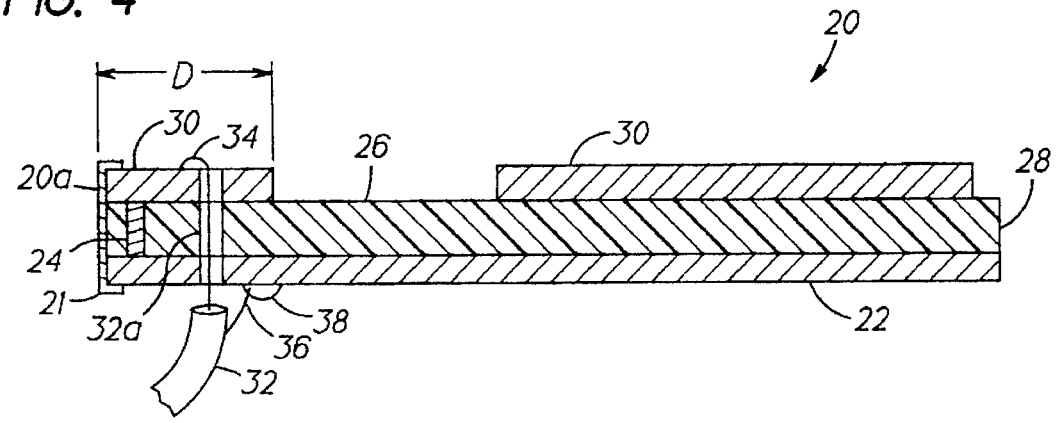
FIG. 4 is a cross-sectional view, not to scale, taken along the section line 4—4 of FIG. 3.

FIGS. 3 and 4 illustrate a partially shorted, double C-patch antenna 20 in accordance with a preferred embodiment of this invention. To reduce the overall length of the double C-patch antenna 20 to approximately one half of the length shown in FIG. 2, the zero potential plane of the antenna 10, which lies between the two apertures and which is excited with the dominant mode, is short-circuited by a plurality of electrically conductive vias or posts 24. To further reduce the size of the partially shorted, double C-patch antenna 20 only a small portion of the entire length of the shorted edge 20*a* is shorted-circuited (hence the term 'partially shorted').

Although the partially shorted embodiment is presently preferred, it is also within the scope of this invention to provide a continuous short along the edge 20*a*. By example, a length of electrically conductive material (e.g., electrically conductive tape shown as 21 in FIG. 4) can be wrapped around the edge 20*a* to short the ground plane 22 to the radiating patch metalization 30.

The entire length of the partially shorted edge 20*a* is defined to be the width (W1) of the antenna 20, while the length (L1) of the antenna is the distance between the partially shorted edge 20*a* and the main radiating edge 20*b* which is parallel to the partially shorted edge 20*a*. The side of the rectangular aperture 26 which is parallel to the partially shorted edge is defined to be the width (W2) of the aperture 26, while the side of the aperture that is perpendicular to the width W2 is defined to be the aperture length L2. The length (L1) of the partially shorted, double C-patch antenna 20 is less than one half of the length of a conventional quarter-wavelength shorted rectangular microstrip antenna resonating at the same frequency and having the same width and thickness. It should be noted that the Length and Width convention in FIG. 3 has been reversed from that used when describing the conventional C-patch antenna of FIG. 1.

It should be further noted that the geometry of the double C-patch antenna embodiment of FIG. 2, in particular the existence of the zero potential plane between the apertures 12*a* and 12*b*, makes it possible to form the partially shorted embodiment of FIG. 3. That is, the conventional C-patch antenna shown in FIG. 1, because of a lack of such symmetry, is not easily (if at all) capable of having the radiating patch shorted to the ground plane.

EXAMPLE

An embodiment of the partially shorted, double C-patch antenna 20 is designed to resonate at approximately 900 MHz, a frequency that is close to the ISM, cellular and paging frequency bands specified for use in the United States. The total size (L1×W1) of the antenna 24 is 2.7 cm×2.7 cm. The antenna 20 employs a dielectric layer 28 comprised of, by example, Duroid 6002 having a dielectric constant of 2.94 and a loss tangent of 0.0012. The thickness of the dielectric layer is 0.1016 cm. A density of electrodeposited copper clad that forms the ground plane 22 and the patch antenna metalization 30 is 0.5 oz per square foot. The length (L2) of the aperture 26 is 0.7 cm, the width (W2) of the aperture 26 is 2 cm, and the edge of the aperture 26 is located 0.6 cm from the partially shorted edge 20*a* (shown as the distance D in FIG. 4). That is, in the preferred embodiment D is approximately equal to L2. The input impedance of the antenna 20 is approximately 50 ohms, and the antenna is preferably coaxially fed from a coaxial cable 32 that has a conductor 32*a* that passes through an opening within the ground plane 22, through the dielectric layer 28, and which is soldered to the antenna radiating patch metalization 30 at point 34. A cable shield 36 is soldered to the ground plane 22 at point 38. The coaxial feed point 34, for a 50 ohm input impedance, is preferably located at a distance that is approximately D/2 from the partially shorted edge 20*a*, and approximately W1/2 from the two opposing sides that are parallel to the length dimension L1. The exact position of the feed point 34 for a given embodiment is a function of the desired input impedance. A clearance area 40 of approximately 2 mm is left between the radiating edge 20*b* of the antenna and the edge of the dielectric layer 28.

It has been determined that the effect of the human body on the operation of the antenna 20 is negligible. This is because such a double C-patch antenna configuration is excited mainly by a magnetic current rather than by an electric current. Furthermore, the ground plane 22 of the antenna 20 also functions as a shield against adjacent materials, such as circuit components in the PCMCIA communication card 1 and any other metallic materials that may be found in the PCMCIA slot 3.

The ground plane 22 of the antenna 20 is preferably truncated. In the presently preferred embodiment of this invention the dimensions of the ground plane 20 are nearly the same as those of the radiation patch 30. Because of this, and because of the geometry of the partially shorted, double C-patch antenna 20, the generated radiation patterns are isotropic. Furthermore, the antenna 20 is sensitive to both vertically and horizontally polarized waves. Moreover, the total size of the antenna 20 is much smaller than a conventional quarter-wavelength rectangular microstrip antenna, which conventionally assumes infinitely large ground plane dimensions.

However, it should be noted that truncating the ground plane 22 of the partially shorted, double C-patch antenna 20 does not adversely effect the efficiency of the antenna. This is clearly different from a conventional rectangular microstrip antenna, where truncating the ground plane along the radiating edge(s) reduces the gain considerably.

To improve the manufacturability of the shorted, double C-patch antenna 20, the electric short circuit at the shorted edge 20*a* is made by a small number (preferably at least three) of the relatively thin (e.g., 0.25 mm) shorting posts 24. However, and as was stated previously, it is within the scope of this invention to use a continuous short circuit that runs along all or most of the edge 20*a*.

The partially shorted, double C-patch antenna 20 does not have a regular shape and, as such, it is difficult to theoretically study the effect of the circuit components in the PCMCIA card and the metallic materials in the PCMCIA slot on the operation of the antenna. Therefore, the performance of the partially shorted, double C-patch antenna 20, both inside and outside the PCMCIA Type II slot 3, has been determined experimentally.

Figure 5:
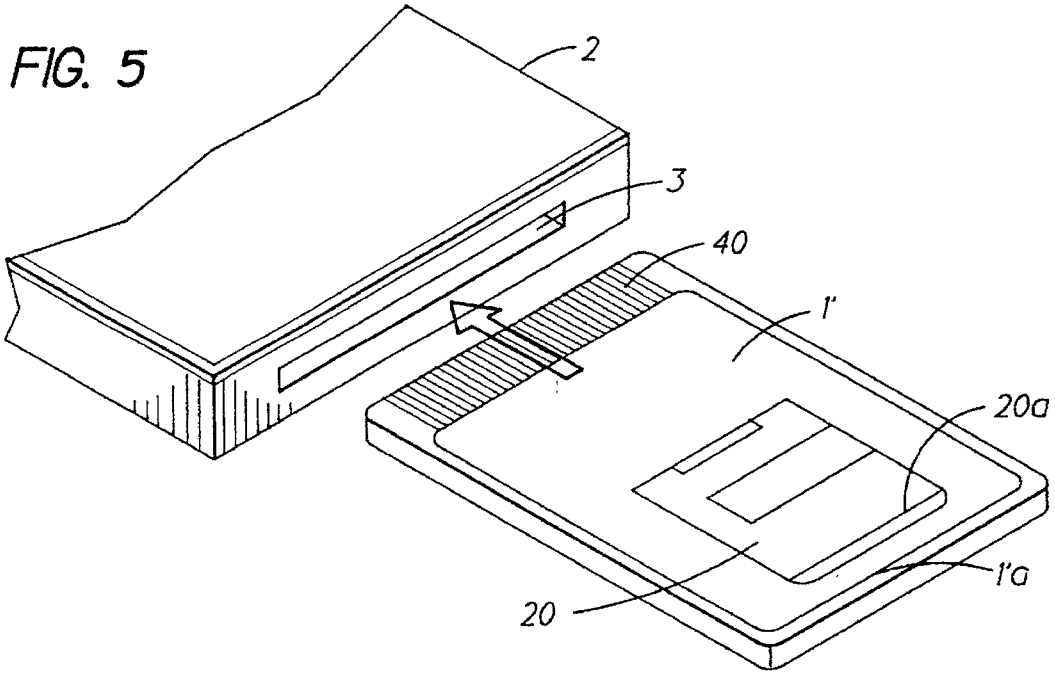
FIG. 5 shows a preferred orientation for the partially shorted, double C-patch antenna when contained within a wireless communications PCMCIA PC card that is installed within a host system.

Referring to FIG. 5, when making the measurements the antenna 20 was located close to the outer edge 1*a* ' of a PCMCIA card 1' with the main radiating edge 20*a* of the antenna 20 was facing outward (i.e., towards the slot door when installed). In this case, and when the PCMCIA card 1' is completely inserted inside the PCMCIA slot 3, the main radiating edge 20*a* of the antenna 20 is approximately parallel with and near to the outer door of the slot 3. It should be realized when viewing FIG. 5 that, in practice, the antenna 20 will be contained within the outer shell of the PCMCIA card enclosure, and would not normally be visible to a user.

Figure 6:
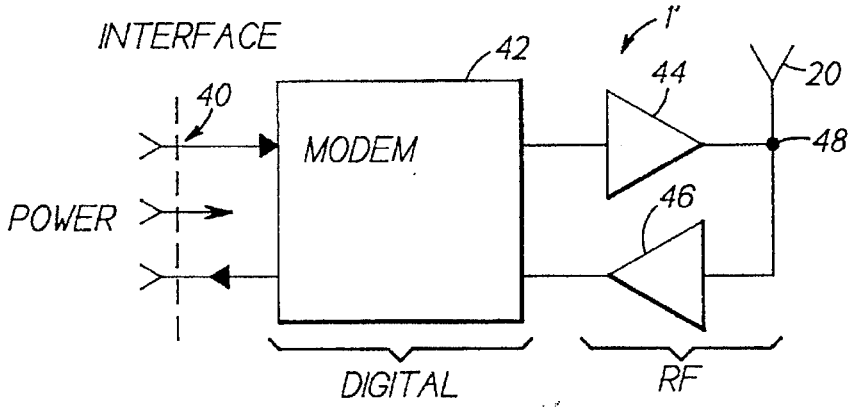
FIG. 6 is a simplified block diagram of the wireless communications PCMCIA PC card of FIG. 5.
Figure 7:
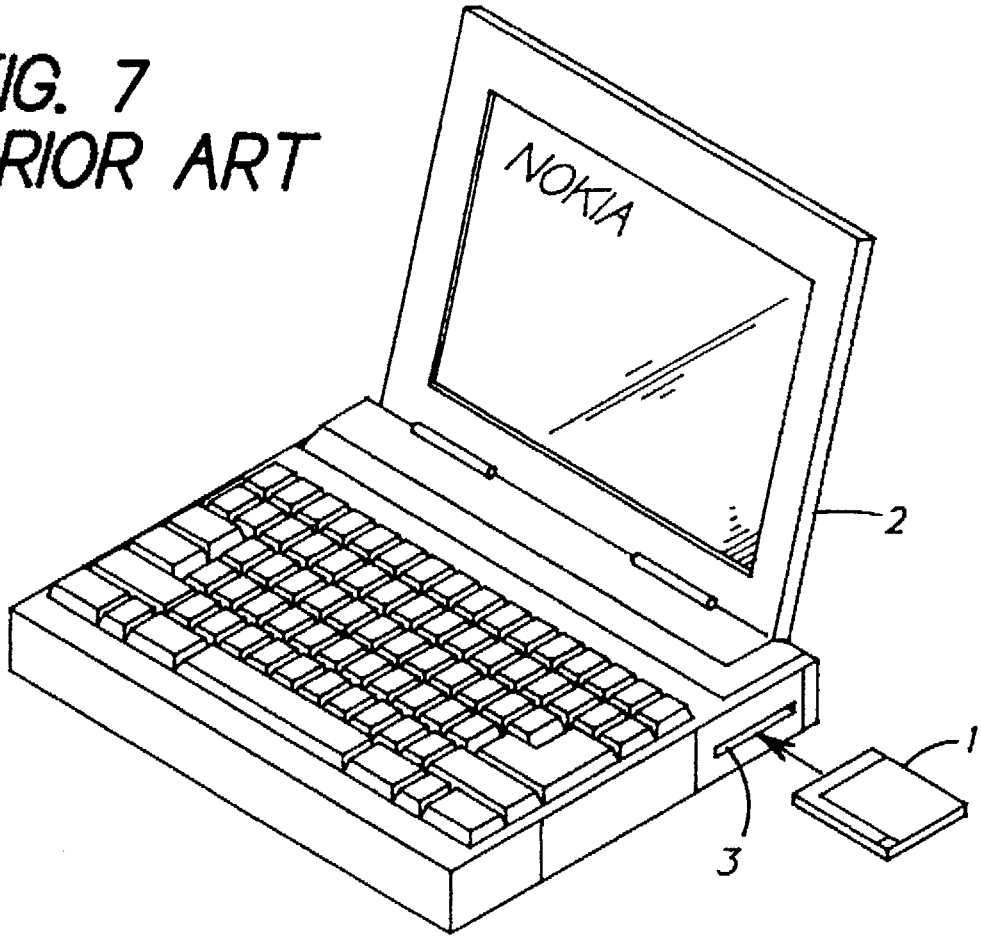
FIG. 7 PRIOR ART
FIG. 7 is a simplified elevational view of a portable computer and a PCMCIA PC card, in accordance with the prior art.

FIG. 6 is a simplified block diagram of the wireless communications PCMCIA card 1' that is constructed in accordance with this invention. Referring also to FIG. 5, the card 1' includes a PCMCIA electrical interface 40 that bidirectionally couples the PCMCIA card 1' to the host computer 2. The PCMCIA card 1' includes a digital modulator/demodulator (MODEM) 42, an RF transmitter 44, an RF receiver 46, and the partially shorted, double C-patch antenna 20 (FIGS. 3 and 4) of this invention. A diplexer 48 can be provided for coupling the antenna 20 to the output of the transmitter 44 and to the input of the receiver 46. Information to be transmitted, such as digital signalling information, digital paging information, or digitized speech, is input to the modem 42 for modulating an RF carrier prior to amplification and transmission from the antenna 20. Received information, such as digital signalling information, digital paging information, or digitized speech, is received at the antenna 20, is amplified by the receiver 46, and is demodulated by the modem 42 to recover the baseband digital communications and signalling information. Digital information to be transmitted is received from the host computer 2 over the interface 40, while received digital information is output to the host computer 2 over the interface 40.

It is been determined that inserting the antenna 20 inside of the PCMCIA Type II slot 3 has a negligible effect on the resonant frequency and the return loss of the antenna. The corresponding radiation patterns were measured in the principal planes. In these measurements, the antenna 20 was immersed in both vertically and horizontally polarized waves to determine the dependence of its performance on the polarization of the incident waves. It has been determined that the radiation patterns are nearly isometric and polarization independent. Furthermore, the performance of the antenna 20 inside the PCMCIA Type II slot 3 is excellent, and is substantially identical to the performance outside of the slot. Similar results were obtained in the other polarization plane. However, the horizontal plane is the most important one for this application, especially if the PCMCIA card 1' is operating inside the PCMCIA slot 3 within a personal computer, because personal computers are usually operated in a horizontal position.

The measurements were repeated inside several PCMCIA slots in different portable computers and similar results were obtained. Furthermore, these measurements were repeated while a palmtop computer, containing the antenna 20 inside its PCMCIA slot 3, was hand-held and also while inside the operator's pocket. It was found that the human body has a negligible effect on the performance of the antenna 20.

In accordance with the foregoing it has been shown that the small, shorted (partial or continuous), double C-patch antenna 20, on a truncated ground plane, has been successfully integrated with a wireless communications PCMCIA card 1'. The shorted, double C-patch antenna 20 has the same performance characteristics in both free space and inside the PCMCIA slot 3 of a personal computer. The PCMCIA card 1' containing the antenna 20 has a good reception sensitivity from any direction, regardless of its orientation, because the shorted, double C-patch antenna 20 has isotropic radiation patterns and is sensitive to both vertically and horizontally polarized radio waves. Furthermore, the shorted, double C-patch antenna 20 exhibits excellent performance when closely adjacent to thehuman body. As a result, the wireless communications PCMCIA card 1' exhibits a high reception sensitivity when it is hand-held and also when it operated inside of an operator's pocket.

While the invention has been particularly shown and described with respect to preferred embodiments thereof, it will be understood by those skilled in the art that changes in form and details may be made therein without departing from the scope and spirit of the invention. By example, the various linear dimensions, thicknesses, resonant frequencies, and material types can be modified, and the resulting modified structure will still fall within the scope of the teaching of this invention. Further by example, the aperture length (L2) may have a value that is equal to approximately 20% to approximately 35% of the length (L1), and a width (W2) having a value that is equal to approximately 15% to approximately 40% less than the width (W1).

What is claimed is:

1. An antenna structure, comprising:

a ground plane;

a layer of dielectric material having a first surface overlying said ground plane and an opposing second surface;

an electrically conductive layer overlying said second opposing surface of said dielectric layer, said electrically conductive layer being in the shape of a parallelogram and having a first rectangularly shaped radiating aperture having a length that extends along a first edge of said electrically conductive layer and a width that extends towards an oppositely disposed second edge, said electrically conductive layer further having a second rectangularly shaped radiating aperature having a length that extends along said first edge of said electrically conductive layer and a width that extends towards said oppositely disposed second edge, said first and second radiating apertures having a zero potential plane disposed therebetween; and means for coupling radio frequency energy into or out of said electrically conductive layer, said coupling means being located within said zero potential plane and further being located nearer to one of said radiating apertures than the other.

2. An antenna structure as set forth in claim 1 wherein a sum of lengths of each of said first and second apertures has a value that is equal to approximately 20% to approximately 35% of a length of said first edge.

3. An antenna structure as set forth in claim 1 wherein said width of each of said first and second apertures has a value that is equal to approximately 15% to approximately 40% less than a width of said electrically conductive layer.

4. An antenna structure as set forth in claim 1 wherein said coupling means is comprised of means for connecting a coaxial cable to said electrically conductive layer.

5. An antenna structure, comprising:

a ground plane;

a layer of dielectric material having a first surface overlying said ground plane and an opposing second surface;

an electrically conductive layer overlying said second opposing surface of said dielectric layer, said electrically conductive layer being in the shape of a parallelogram and having a rectangularly shaped radiating aperture having a length that extends along a first edge of said electrically conductive layer and a width that extends towards an oppositely disposed second edge, said length having a value that is equal to approximately 20% to approximately 35% of a length of said first edge;

means for shorting said electrically conductive layer to said ground plane at a region adjacent to a third edge of said electrically conductive layer; and means for coupling radio frequency energy into or out of said electrically conductive layer, said coupling means being located between said radiating aperture and said third edge.

6. An antenna structure as set forth in claim 5, wherein said width of said aperture has a value that is equal to approximately 15% to approximately 40% less than a width of said electrically conductive layer, and wherein said aperture is located from said third edge at distance that is approximately equal to said length of said aperture.

7. An antenna structure as set forth in claim 5, wherein said shorting means is comprised of one of a continuous short circuit means and a plurality of electrically conductive feedthroughs that pass through said dielectric layer between said ground plane and said electrically conductive layer.

8. An antenna structure as set forth in claim 5, wherein said couplings means is comprised of means for connecting a coaxial cable to said electrically conductive layer at a point between said aperture and said third edge.

9. An antenna structure as set forth in claim 5, wherein said length of said first edge is less than approximately 8.5 cm, and wherein said third edge has a length that is less than approximately 5.5 cm.

10. An antenna structure as set forth in claim 5, wherein said length of said first edge is approximately equal to a length of said third edge, wherein said length of said first edge is equal to approximately 2.7 cm, wherein said length of said aperture is equal to approximately 0.7 cm, and wherein said width of said aperture is equal to approximately 2 cm.

11. An antenna structure as set forth in claim 5, wherein said ground plane is truncated, and has dimensions that are approximately equal to the dimensions of said electrically conductive layer.

12. A module adapted for insertion into a data processor, said module comprising:

an interface for electrically coupling said module to the data processor;

a modem that is bidirectionally coupled to said interface;

an RF energy transmitter having an input coupled to an output of said modem;

an RF energy receiver having an output coupled to an input of said modem; and a shorted, dual C-patch antenna that is electrically coupled to an output of said RF energy transmitter and to an input of said RF energy receiver, said shorted, dual C-patch antenna comprising, a ground plane;

a layer of dielectric material having a first surface overlaying said ground plane and an opposing second surface;

an electrically conductive layer overlying said second opposing surface of said dielectric layer, said electrically conductive layer being in the shape of a parallelogram and having a radiating aperture having a length that extends along a first edge of said electrically conductive layer and a width that extends towards an oppositely disposed second edge, said length having a value that is equal to approximately 20% to approximately 35% of a length of said first edge;

means for shorting said electrically conductive layer to said ground plane at a region adjacent to a third edge of said electrically conductive layer; and means for coupling said electrically conductive layer to said output of said transmitter and to said input of said receiver, said coupling means being located between said radiating aperture and said third edge;

wherein said width of said aperture has a value that is equal to approximately 15% to approximately 40% less than a width of said electrically conductive layer, and wherein said aperture is located from said third edge at a distance that is approximately equal to said length of said aperture.

13. A module as set forth in claim 12, wherein said shorting means is comprised of a plurality of electrically conductive feedthroughs that pass through said dielectric layer between said ground plane and said electrically conductive layer.

14. A module as set forth in claim 12, wherein said shorting means is comprised of a length of electrically conductive material that extends from said ground plane to said electrically conductive layer.

15. A module as set forth in claim 12, wherein said coupling means is comprised of means for connecting a coaxial cable to said electrically conductive layer at a point between said aperture and said third edge.

16. A module as set forth in claim 12, wherein said length of said first edge is less than approximately 8.5 cm, and wherein said third edge has a length that is less than approximately 5.5 cm.

17. A module as set forth in claim 12, wherein said length of said first edge is approximately equal to a length of said third edge, wherein said length of said first edge is equal to approximately 2.7 cm, wherein said length of said aperture is equal to approximately 0.7 cm, and wherein said width of said aperture is equal to approximately 2 cm.

18. A module as set forth in claim 12, wherein said ground plane is truncated, and has dimensions that are approximately equal to the dimensions of said electrically conductive layer.

19. A module as set forth in claim 12, wherein said module has dimensions of approximately 8.5 cm×5.4 cm by 0.5 cm.

20. A module as set forth in claim 12, wherein said shorted, dual C-patch antenna has a resonant frequency of approximately 900 MHz.

* * * * *